US006209133B1

(12) United States Patent
Hinshaw

(10) Patent No.: US 6,209,133 B1
(45) Date of Patent: Apr. 3, 2001

(54) INTEGRATED BIB/TEETHER APPARATUS

(75) Inventor: Susan Hinshaw, Norton Shores, MI (US)

(73) Assignee: Sassy, Inc., Northbrook, IL (US)

( * ) Notice: Subject to any disclaimer, the term of this patent is extended or adjusted under 35 U.S.C. 154(b) by 0 days.

(21) Appl. No.: 09/420,463

(22) Filed: Oct. 18, 1999

(51) Int. Cl.[7] ..... A61J 17/00; A41B 13/10
(52) U.S. Cl. ..... 2/49.1; 2/49.2; 606/235
(58) Field of Search ..... 2/48, 49.1, 49.2, 2/49.3, 49.4, 49.5, 50, 51, 104, 111, 80, 83, 114; 606/235, 234; 446/28

(56) References Cited

U.S. PATENT DOCUMENTS

| | | | | |
|---|---|---|---|---|
| D. 155,752 | | 10/1949 | Vivaudou | D3/26 |
| 358,367 | * | 2/1887 | Spies | 2/49.2 |
| 615,293 | * | 12/1898 | Maier | 2/49.2 |
| 1,793,737 | * | 2/1931 | Estes | 2/48 |
| 2,244,656 | * | 6/1941 | Asch | 2/49.5 |
| 2,705,011 | | 3/1955 | Newton | 128/359 |
| 3,608,092 | * | 9/1971 | Taranto | 2/49 R |
| 4,475,250 | | 10/1984 | Savin et al. | 2/49 R |
| 4,694,510 | | 9/1987 | Kamrath | 2/49 R |
| 4,697,589 | | 10/1987 | King et al. | 128/359 |
| 4,719,650 | | 1/1988 | Milloy | 2/49 R |
| 4,723,323 | * | 2/1988 | Wright, Jr. | 2/48 |
| 4,733,411 | | 3/1988 | Foti | 2/49 R |
| 5,147,384 | | 9/1992 | La Rocca | 606/234 |
| 5,469,580 | * | 11/1995 | Sobol | 2/50 |
| 5,477,560 | | 12/1995 | Shope | 2/49.1 |
| 5,522,849 | | 6/1996 | Xiques et al. | 606/236 |
| 5,530,968 | * | 7/1996 | Crokett | 2/49.2 |
| 5,960,471 | * | 10/1999 | Burton | 2/49.2 |

FOREIGN PATENT DOCUMENTS

| | | | | |
|---|---|---|---|---|
| 2418 | * | 1/1903 | (DE) | 2/49.1 |
| 1193862 | * | 11/1959 | (FR) | 2/49.1 |

* cited by examiner

*Primary Examiner*—Amy B. Vanatta
(74) *Attorney, Agent, or Firm*—Dick and Harris

(57) ABSTRACT

The present invention is directed to a teething bib having a front side, a back side, an upper portion, a bottom portion, an outer periphery having an outer peripheral edge and teething material operably associated with at least a portion of the outer periphery of the bib. The teething material preferably emanates from the outer peripheral edge of the bib, and may extend around the entire outer periphery. The teething material may also includes gaps. The bib includes an opening for an infant's head, and may also include a fastening member for folding the bottom of the bib into a pocket for the collection of food or liquid during feeding.

26 Claims, 2 Drawing Sheets

INTEGRATED BIB/TEETHER APPARATUS

BACKGROUND OF THE INVENTION

1. Field of the Invention

The present invention relates in general to a bib for an infant and, more particularly, to a bib with a teething material integral thereto.

2. Background Art

Infant bibs have been known in the art for many years. In particular, many of these bibs have had various articles, such as toys, playthings or pacifiers, directly attached by a tether, loop or stitching. Attaching these articles directly to the bib provides an infant with easy access to these articles, while preventing the articles from becoming easily lost.

Yet other bibs have included teething material attached directly thereto. For instance, Kamrath, U.S. Pat. No. 4,694,510 discloses a bib with a teething material attached to the bottom of the bib on both the front and back sides. The teething material may be molded, sewn, or snapped onto the bottom of the bib.

While Kamrath provided an advantage by integrating teething material directly into the bib, teething material is typically heavier than the remainder of a cloth bib. As a result, a large piece of rubber attached to and covering a substantial portion of the bottom of a bib is heavy and provides additional strain when the bib is placed around an infant's neck. Moreover, such a design provides teething material in essentially only one location, at the bottom of the bib, thus leaving the remaining sides of the bib susceptible to biting, sucking or chewing by the infant and potential fraying and/or eroding of the bib. Bib fraying or eroding, in turn, may lead to ingestion of portions of the bib by the infant.

Accordingly, there remains a need for a bib having teething material integrated thereto which more evenly distributes the weight of the teething material over the entirety of the bib. Moreover, there also remains a need for a bib with teething material distributed over a larger portion of the outer periphery of the bib to permit infant access to the teething material at virtually any accessible point on the outside of the bib. Finally, it is desirable to provide a teether bib that may be folded up to form a pocket for catching crumbs and other food, while also facilitating the teething process.

SUMMARY OF THE INVENTION

The present invention comprises a teething bib having a front side, a back side, an upper half, a lower half, a bottom, an outer periphery having an outer peripheral edge and teething material operably associated with at least a portion of the outer periphery of the bib. The bib includes an opening for an infant's head.

The teething material preferably emanates from the outer peripheral edge of the bib. In one embodiment, the teething material extends around the substantial entirety of the outer periphery of the bib. In another embodiment, the teething material extends around the substantial entirety of the bottom half of the bib and at least a portion of the upper half of the bib. In yet another embodiment, the teething material is located on both the front and back of the bib and includes gaps to reduce the weight of the bib.

The bib preferably further includes a fastening member for folding the bottom of the bib into a pocket. The pocket may function as a crumb catcher, or a hiding place for food and toys for infant amusement. Furthermore, folding the bib may also conveniently place the teething material closer to the infant's mouth, and remove the bib from any chance of interfering with the diaper changing process.

DETAILED DESCRIPTION OF THE INVENTION

Figure 1:
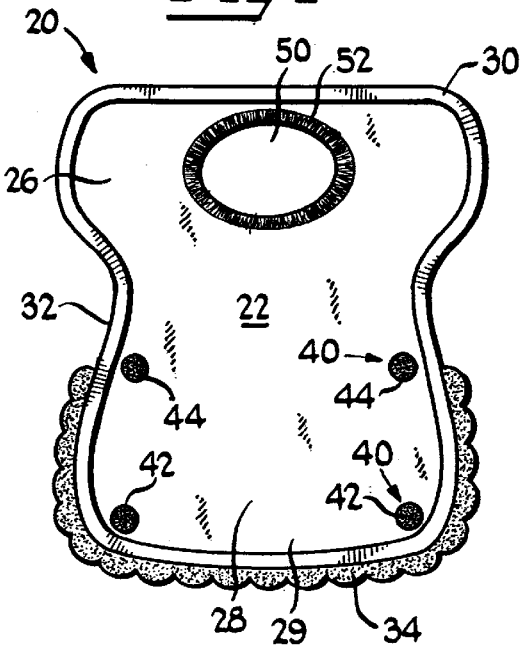
FIG. 1 is a front elevational view of the teething bib according to one embodiment of the present invention.

While this invention is susceptible of embodiment in many different forms, there are shown in the drawings and will be described in detail several specific embodiments with the understanding that the present disclosure is to be considered as an exemplification of the principles of the invention and is not intended to limit the invention to the embodiments illustrated.

Bib 20 is shown in FIGS. 1–4 as comprising front 22, back 24, upper half 26, bottom half 28, bottom 29, outer periphery 30, outer peripheral ledge 32, and teething material 34. Bib 20 is preferably constructed from a lightweight fabric that is preferably washable. Further, bib 20 is preferably bound at outer periphery 30 by stitching, fabric tape, or a combination thereof to reinforce both outer periphery 30 and outer peripheral edge 32 against erosion or fraying. Furthermore, bib 20 may be coated with a liquid and/or food resistant liner on one or both of the front and back sides. Alternatively, the bib may be constructed from a liquid and/or food resistant fabric. Certainly, one with ordinary skill in the art would recognize that bib 20 may be comprised of other conventional materials.

Upper half 26 of bib 20 further includes opening 50 for receiving an infant's head. Opening 50 is preferably surrounded by an elastic material to facilitate placement of bib 20, and particularly opening 50, over an infant's head and around an infant's neck. However, while opening is shown in the drawings, it is likewise contemplated that the bib includes any access port or opening which may be either pulled over an infant's head or positioned around an infant's neck and fastened in that position.

Teething material 34 is shown in FIGS. 1–4 as associated with outer periphery 30 of bib 20. Preferably, teething material 34 comprises a non-toxic rubber that does not erode during the teething process. Moreover, teething material 34 is preferably a lightweight rubber to minimize the strain of the bib upon an infant's neck. While suitable materials include polypropylene, EVA and latex rubber, other materials as would be known by those of ordinary skill in the art with the present disclosure before them are likewise contemplated.

Figure 2:
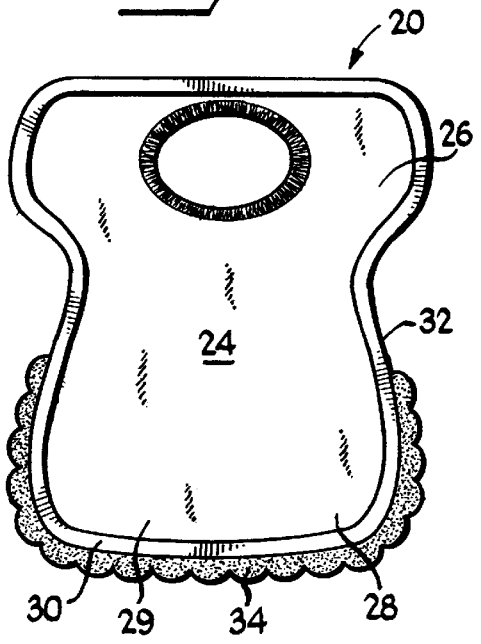
FIG. 2 is a rear perspective view of the teething bib shown in FIG. 1.
Figure 3:
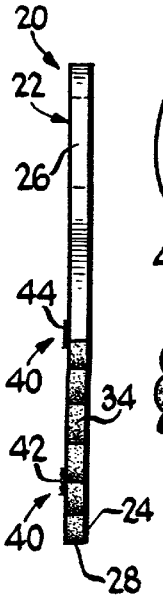
FIG. 3 is a side elevational view of the teething bib shown in FIG. 1.
Figure 4:
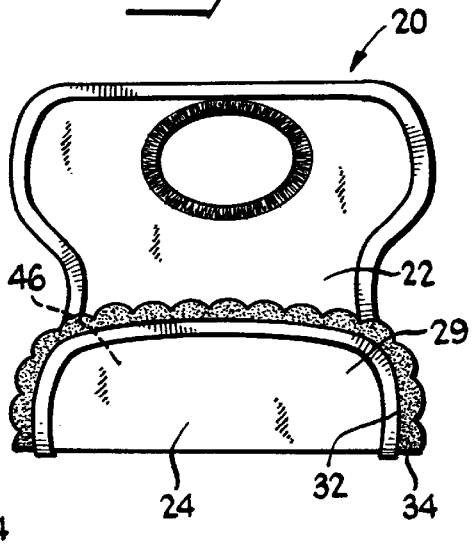
FIG. 4 is a front elevational view of the teething bib shown in FIG. 1 with a portion of the bib folded and secured in a folded orientation.

As shown in FIGS. 1, 2 and 4, teething material emanates from outer peripheral edge 32 of bib 20. Preferably, teething material 34 is sewn into outer periphery 30 to ensure that an infant is precluded from tearing the teething material from the bib. However, it is likewise contemplated that teething material may be molded into the outer periphery of the bib, or snapped on to ensure an integrated fit onto the bib. Preferably, teething material 34 does not extend past outer peripheral edge 32 of bib 20 and onto front 22 of the bib. This distribution minimizes teething material requirements, while also distributing the weight of the teething material more evenly over the bib. Thus, an infant reaps the benefits of a lighter weight bib, while still having access to a teething surface at virtually any convenient peripheral point.

Front 22 of bib 20 further includes fastening member 40. Fastening member 40 preferably comprises a Velcro™-type hook and loop fastening mechanism, preferably including hook regions 42 and loop regions 44. Fastening member 40 permits bottom 29 of the bib to be folded up and over itself and secured in a folded orientation, shown in FIG. 4. In the folded orientation, the two adjacent portions of the folded bib form pocket 46, which acts as a crumb catcher during feeding of an infant. The Velcro™ hook and loop fastening mechanism allows quick and easy formation of pocket 46, while also allowing the pocket to be quickly and easily broken down for wiping, washing or general cleaning of the bib. Moreover, while hook and loop fasteners are shown in FIGS. 1–4, other fastening mechanisms such as a snap, rivet or latch, or other fastening mechanisms as would be contemplated by one of ordinary skill with the present disclosure before them, are likewise contemplated.

Teething material 34 facilitates formation of pocket 46. In particular, the teething material provides separation of the adjacent portion of the bib, thus preventing sticking of one adjacent portion to another and helping to create a pocket opening. Additionally, the extra weight of the heavier teething material maintains the opening in the pocket, thus enhancing the crumb and food catching ability of the bib.

Aside from functioning as a crumb catching pocket, fastening mechanism 40 imparts other advantages to bib 20. For instance, pocket 46 may also form a useful plaything for an infant. Specifically, the pocket functions as a hiding place for food or toys for maintaining an infant's attention or fascination during a meal.

Additionally, folding the bottom of the bib and securing the same in a folded orientation places the teething material on the outer periphery of the bottom of the bib closer to the opening 50 and closer to an infant's head and mouth. Thus, the teething material is more accessible for teething. Furthermore, folding the bib reduces its length. This reduction in length can be advantageous when changing an infant's diaper, as the reduced length may remove a portion of the bib from interfering with the diaper changing process.

Figure 5:
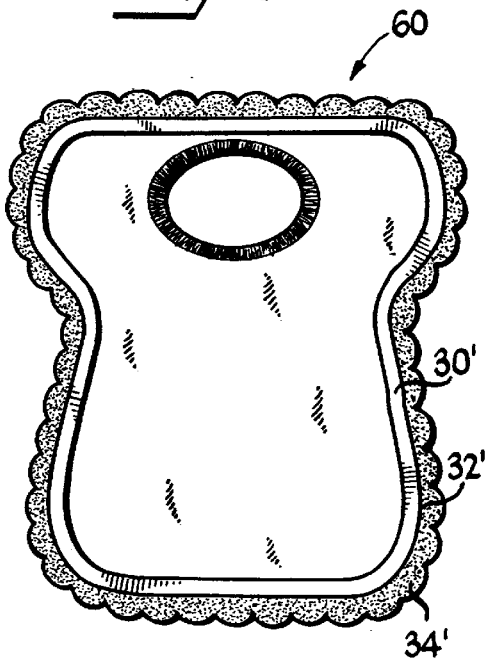
FIG. 5 is a front elevational view of a teething bib according to another embodiment of the present invention.

In another embodiment, shown in FIG. 5, bib 60 likewise includes teething material 34' emanating from outer peripheral edge 32' of outer periphery 30'. Teething material 34' extends around the entirety of the outer peripheral edge of bib 60 to ensure that an infant has unlimited access to teething material on any portion of the bib, no matter which direction the infant may turn its head. Such a configuration still permits the infant to teethe even if the bib is rotated or displaced around the infant's neck. Additionally, the teething material configuration of FIG. 5 precludes an infant from teething on a portion of the outer periphery of the bib which is not covered by teething material, thus preventing fraying or eroding of the bib upon continuous teething, biting or sucking by the infant.

Figure 6:
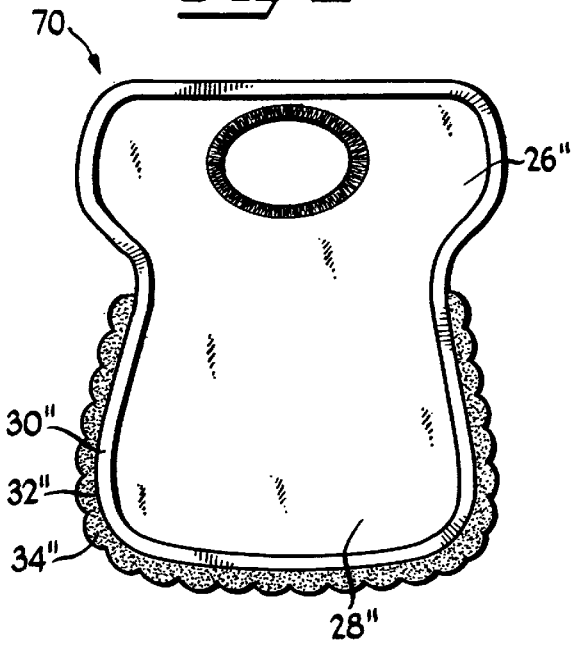
FIG. 6 is a front elevational view of a teething bib according to yet another embodiment of the present invention.

In still another embodiment, bib 70 is shown in FIG. 6 as including teething material 34" which extends from outer peripheral edge 32" of outer periphery 30" of bib 70 in much the same way as had been described with respect to the teething material in FIGS. 1–4 and FIG. 5. However, instead of extending around the entirety of the bib, as in FIG. 5, teething material 34" extends around the substantial portion of the outer periphery of bottom half 28" of the bib and at least a portion of the outer periphery of upper half 26" of the bib. Such a configuration minimizes the amount of teething material required and thus the weight of the bib, while still maintaining teething material in a location which is practically accessible by an infant when the bib hangs down in front of an infant.

Figure 7:
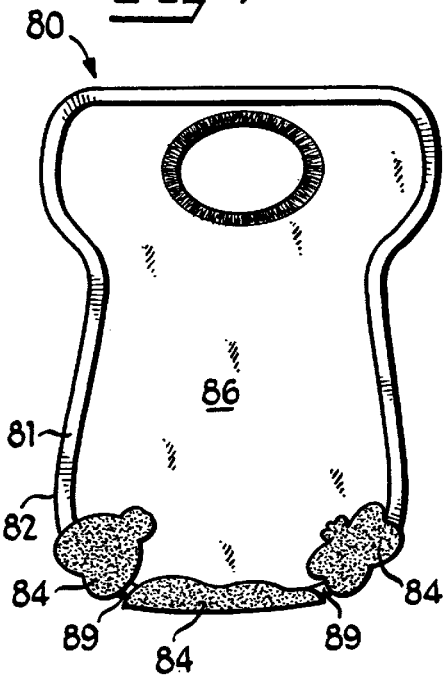
FIG. 7 is a front elevational view of a teething bib according to still another embodiment of the present invention.
Figure 8:
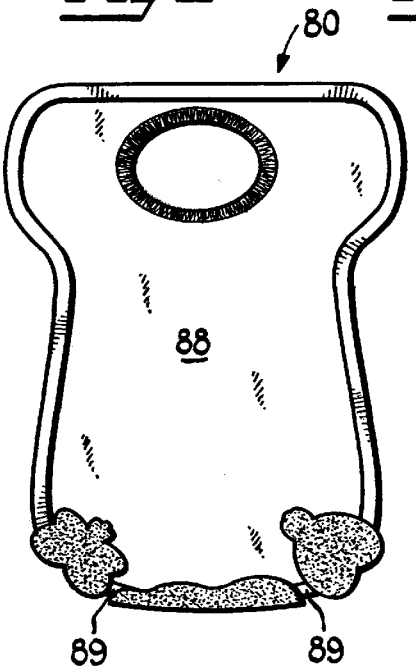
FIG. 8 is a rear elevational view of the teething bib shown in FIG. 7.
Figure 9:
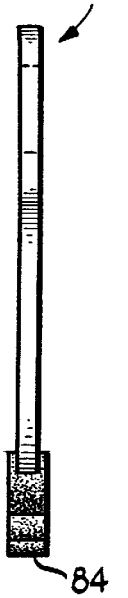
FIG. 9 is a side elevational view of the teething bib shown in FIG. 7.

In another embodiment, shown in FIGS. 7–9, bib 80 comprises outer periphery 81, outer peripheral edge 82 and teething material 84. As can be seen in FIGS. 7–8, teething material 84 is associated with outer periphery 81 at the bottom of bib 80, and is located on both front 86 and back 88 of bib 80. Teething material 84 preferably includes gaps 89 which define a plurality of segments of teething material. Gaps 89 minimize the weight of the teething material in bib 80 as it rests around an infant's neck. At the same time, gaps 89 are preferably small in size so as to preclude direct contact between an infant's teeth and/or gums with outer peripheral edge 82 of the portions of bib 80 exposed by gaps 89. Furthermore, though not shown in FIG. 7, bib 80 may further include a fastening member as described with respect to FIGS. 1–4 above. The teething material of FIGS. 7–9, preferably, may be formed into toy shapes for the infant's enjoyment.

Figure 10:
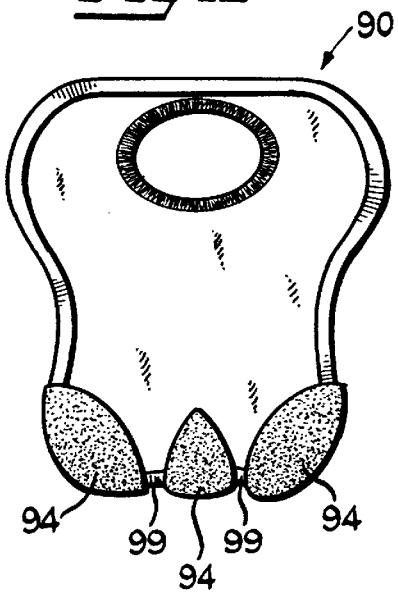
FIG. 10 is a front elevational view of a teething bib according to another embodiment of the present invention.

In yet another embodiment, bib 90 is shown in FIG. 10 as having teething material 94 associated with the bottom portion of the bib on the outer periphery. Much like bib 80 of FIGS. 7–9, bib 90 includes gaps 99 between separate segments of teething material 94. As can be seen from FIG. 10, teething material 94 conforms to the shape of bib 90. Thus, teething material 94 still is accessible on a large portion of the bottom half of bib 90 for easy access.

The foregoing description and drawings merely explain and illustrate the invention, and the invention is not limited thereto, except insofar as the appended claims are so limited, as those skilled in the art who have the present disclosure before them will be able to make modifications and variations therein without departing from the scope of the invention.

What is claimed is:

1. A teething bib for infants comprising:

a front side, a back side, an upper portion, a bottom portion, at least two side portions and an outer periphery having an outer peripheral edge;

an opening region within said upper portion to permit placement of said bib around an infant's neck, teething material operably integrated into at least said bottom portion and extending, at least partially, into said two side portions immediately adjacent said bottom portion, along the outer periphery of the bib, said teething material emanating from a position substantially adjacent said outer peripheral edge and extending outwardly from the outer peripheral edge of said outer periphery of said bib for tactile grasping and manipulation by an infant.

2. The teething bib according to claim 1 wherein said teething material extends around a substantial portion of the outer periphery of the bottom portion of the bib and at least a portion of the outer periphery of the upper portion of the bib.

3. The teething bib according to claim 2 wherein said teething material extends around the substantial entirety of the outer periphery of the bib.

4. The teething bib according to claim 1 wherein said teething material includes at least one gap operably positioned between a plurality of segments of teething material.

5. The teething bib according to claim 4 wherein said at least one gap in said teething material is substantially small so as to preclude direct contact between an infant's teeth with the outer peripheral edge of the portions of the bib exposed by said at least one gap.

6. The teething bib according to claim 1 wherein said teething material comprises a non-toxic rubber.

7. The teething bib according to claim 1 further including at least one fastening member to allow at least a portion of the bib to be folded over another portion of the bib and secured in a folded orientation.

8. The teething bib according to claim 7, wherein the bib has a length and at least a portion of the bottom portion of the bib is folded over itself to reduce the overall length of the bib.

9. The teething bib according to claim 7 wherein at least a portion of said teething material is positioned closer to the opening region within said upper portion of said bib, upon folding the bib into said folded orientation.

10. The teething bib according to claim 7, wherein folding of said bib into said folded orientation creates a pocket for catching food and liquid during feeding of the infant.

11. The teething bib according to claim 7 wherein said fastening member comprises at least one pair of hook and loop fasteners.

12. The teething bib according to claim 11 wherein said at least one pair of hook and loop fasteners are positioned on the front of the bib.

13. The teething bib according to claim 11 wherein said fastening member comprises at least two pairs of hook and loop fasteners.

14. A teething bib for infants comprising:

a front side, a back side, an upper portion, a bottom portion, at least two side portions and an outer periphery having an outer peripheral edge;

an opening region within said upper portion to permit placement of said bib around an infant's neck, teething material operably integrated into at least said bottom portion and extending, at least partially, into said two side portions immediately adjacent said bottom portion, along the outer periphery of the bib, said teething material extending outwardly from the outer peripheral edge of said outer periphery of said bib for tactile grasping and manipulation by an infant, and said teething material extending around a substantial portion of the outer periphery of the bottom portion of the bib and at least a portion of the outer periphery of the upper portion of the bib.

15. The teething bib according to claim 14 wherein said teething material extends around the substantial entirety of the outer periphery of the bib.

16. A teething bib for infants comprising:

a front side, a back side, an upper portion, a bottom portion, at least two side portions and an outer periphery having an outer peripheral edge;

an opening region within said upper portion to permit placement of said bib around an infant's neck, teething material operably integrated into at least said bottom portion and extending, at least partially, into said two side portions immediately adjacent said bottom portion, along the outer periphery of the bib, said teething material extending outwardly from the outer peripheral edge of said outer periphery of said bib for tactile grasping and manipulation by an infant, and said teething material including at least one gap operably positioned between a plurality of segments of teething material.

17. The teething bib according to claim 16 wherein said at least one gap in said teething material is substantially small so as to preclude direct contact between an infant's teeth with the outer peripheral edge of the portions of the bib exposed by said at least one gap.

18. A teething bib for infants comprising:

a front side, a back side, an upper portion, a bottom portion, at least two side portions and an outer periphery having an outer peripheral edge;

an opening region within said upper portion to permit placement of said bib around an infant's neck, teething material operably integrated into at least said bottom portion and extending, at least partially, into said two side portions immediately adjacent said bottom portion, along the outer periphery of the bib, said teething material extending outwardly from the outer peripheral edge of said outer periphery of said bib for tactile grasping and manipulation by an infant; and at least one fastening member associated with said bib to allow at least a portion of the bib to be folded over another portion of the bib and secured in a folded orientation.

19. The teething bib according to claim 18 wherein the bib has a length and at least a portion of the bottom portion of the bib is folded over itself to reduce the overall length of the bib.

20. The teething bib according to claim 18 wherein at least a portion of said teething material is positioned closer to the opening region within said upper portion of said bib, upon folding the bib into said folded orientation.

21. The teething bib according to claim 18 wherein folding of said bib into said folded orientation creates a pocket for catching food and liquid during feeding of the infant.

22. The teething bib according to claim 18 wherein said fastening member comprises at least one pair of hook and loop fasteners.

23. The teething bib according to claim 22 wherein said at least one pair of hook and loop fasteners are positioned on the front of the bib.

24. The teething bib according to claim 22 wherein said fastening member comprises at least two pairs of hook and loop fasteners.

25. A teething bib for infants comprising:

a front side, a back side, an upper portion, a bottom portion, at least two side portions and an outer periphery having an outer peripheral edge;

an opening region within said upper portion to permit placement of said bib around an infant's neck, teething material operably integrated into at least said bottom portion and extending, at least partially, into said two side portions immediately adjacent said bottom portion, along the outer periphery of the bib, said teething material being operably integrated into said bottom portion of said bib to form a teething material region having a top edge substantially adjacent the longitudinal center of said bib, a bottom edge proximate to said bottom portion of said bib and two side edges, each respectively adjacent to one of said side portions of said bib, at least one of said side edges of said teething material region extending up at least one of said respective side portions of said bib to a height exceeding the height of said top edge of said teething material region, said differential in said height of said at least one side edge relative to said top edge serving to impart increased flexibility to said bib.

26. The teething bib according to claim 25 wherein said teething material extends outwardly from the outer peripheral edge of said outer periphery of said bib for tactile grasping and manipulation by an infant.

* * * * *